US009437147B2

(12) United States Patent
Wu et al.

(10) Patent No.: US 9,437,147 B2
(45) Date of Patent: Sep. 6, 2016

(54) POLARITY INVERSION DRIVING METHOD, DRIVING APPARATUS AND LIQUID CRYSTAL DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Xingji Wu, Beijing (CN); Yizhen Xu, Beijing (CN); Liang Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/367,825

(22) PCT Filed: May 8, 2013

(86) PCT No.: PCT/CN2013/075314

§ 371 (c)(1),
(2) Date: Jun. 20, 2014

(87) PCT Pub. No.: WO2014/134867

PCT Pub. Date: Sep. 12, 2014

(65) Prior Publication Data

US 2015/0221269 A1 Aug. 6, 2015

(30) Foreign Application Priority Data

Mar. 6, 2013 (CN) ..... 2013 1 0071331

(51) Int. Cl.
*G09G 3/36* (2006.01)

(52) U.S. Cl.
CPC ..... *G09G 3/3614* (2013.01); *G09G 3/36* (2013.01); *G09G 3/3688* (2013.01); (Continued)

(58) Field of Classification Search
CPC ..... G09G 3/3614; G09G 2310/066; G09G 2300/0866; G09G 3/36; G09G 3/3688; G09G 2300/0247
USPC ..... 345/87, 94, 96, 204
See application file for complete search history.

(56) References Cited

U.S. PATENT DOCUMENTS 5,621,425 A * 4/1997 Hoshino et al. ..... 345/94
2010/0188380 A1* 7/2010 Nose ..... G09G 3/3629 345/209

(Continued)

FOREIGN PATENT DOCUMENTS

CN 101226724 A 7/2008
CN 102629453 A 8/2012

(Continued)

OTHER PUBLICATIONS

Written Opinion of the International Searching Authority dated Dec. 12, 2013, in PCT Application No. PCT/CN2013/075314, 6 pages.

(Continued)

*Primary Examiner* — Jennifer Nguyen
(74) *Attorney, Agent, or Firm* — Ladas & Parry LLP

(57) ABSTRACT

A polarity inversion driving method, a driving apparatus and a liquid crystal display device, for attenuating the flickers due to POL inversion. The polarity inversion driving method is used for inversion of polarity of pixels on the liquid crystal panel, and comprises: generating a polarity inversion reference signal for reflecting selection of polarity of each row of pixels on the liquid crystal panel; generating a control signal comprising control levels generated in m frames, where m is an integer higher than or equal to two, wherein width of the control level in each of the m frames is gradually increased in chronological order to be equal to a time length of one frame; as an alternative, the width of the control level in each of the m frames is gradually decreased in chronological order from the time length of one frame to zero; and generating a polarity inversion signal from the polarity inversion reference signal and the control signal.

18 Claims, 4 Drawing Sheets

(52) U.S. Cl.
CPC . *G09G 2310/08* (2013.01); *G09G 2320/0204* (2013.01); *G09G 2320/0233* (2013.01); *G09G 2320/0247* (2013.01); *G09G 2360/16* (2013.01); *G09G 2370/08* (2013.01)

(56) References Cited

U.S. PATENT DOCUMENTS

| | | | | |
|---|---|---|---|---|
| 2010/0265282 | A1* | 10/2010 | Ide et al. | 345/691 |
| 2011/0134092 | A1 | 6/2011 | Lee et al. | |
| 2012/0169782 | A1* | 7/2012 | Chen et al. | 345/690 |
| 2012/0268444 | A1 | 10/2012 | Takahashi | |

FOREIGN PATENT DOCUMENTS

| | | | |
|---|---|---|---|
| EP | 2717252 | A1 | 4/2014 |
| WO | 2012/161000 | A1 | 11/2012 |

OTHER PUBLICATIONS

English translation of Written Opinion of the International Searching Authority dated Dec. 12, 2013, in PCT Application No. PCT/CN2013/075314, 5 pages.
English Abstract of CN 102629453 A.
First Office Action issued by the Chinese Patent Office for Chinese Patent Application No. 201310071331.X dated Jul. 25, 2014, 7pgs.
English translation of First Office Action issued by the Chinese Patent Office for Chinese Patent Application No. 201310071331.X dated Jul. 25, 2014, 7pgs.
Second Office Action issued by the Chinese Patent Office for Chinese Patent Application No. 201310071331.X dated Mar. 12, 2015, 3 pgs.
English translation of Second Office Action issued by the Chinese Patent Office for Chinese Patent Application No. 201310071331.X dated Mar. 12, 2015, 2 pgs.
Third Chinese Office Action Appln. No. 201310071331.X; Dated Sep. 14, 2015.
Extended European Search Report dated Jun. 29, 2016; Appln. No. 13861515.8-1904/2966640 PCT/CN2013075314.

* cited by examiner

POLARITY INVERSION DRIVING METHOD, DRIVING APPARATUS AND LIQUID CRYSTAL DISPLAY DEVICE

CROSS REFERENCE TO RELATED APPLICATIONS

This application is based on International Application No. PCT/CN2013/075314 filed on May 8, 2013, which claims priority to Chinese National Application No. 201310071331.X filed on Mar. 6, 2013. The entire contents of each and every foregoing application are incorporated herein by reference.

TECHNICAL FIELD

The present disclosure relates to a field of liquid crystal display, and particularly, to a polarity inversion driving method, a driving apparatus and a liquid crystal display device.

BACKGROUND

With development of display technology, liquid crystal displays (LCDs) become more and more popular due to its advantages such as portability, low radiation and the like. A major issue puzzling the LCD is the issue of image sticking which generally includes area sticking and line ship sticking, where the line ship sticking is generated for the reason that the direct component caused by pixel voltage difference between the two adjacent frames on a certain row in certain pictures acts on liquid crystal molecules for a long time. For example, a certain picture is a black-write interleaving picture, where the 99-th and 100-th rows are white and the 101-th row is black, and when the broadcast television transmits interleaved scanning signals, that is, only odd rows or even rows of signals are transmitted; for example, at the time of the N-th frame, signal which is white on the 99-th row and black on the 101-th row is transmitted; that is, only the odd rows are transmitted, and the data on the 100-th row is automatically calculated at a display terminal and a grey picture is generated between the black and the white; at the time of the (N+1)-th frame, the broadcast television transmits signals on even rows; in this case, a real signal on the 100-th row will be transmitted, which is a white picture; it can be seen that, pixel voltages on the 100-th row are different between the N-th row and the (N+1)-th row; therefore, the direct component is generated, and the line ship sticking will be generated for the reason that the direct components act on the liquid crystal molecules for a long time.

A present approach to solve the issue of the image sticking is POL (Polarity Inversion) inversion, and the POL is a signal for controlling polarity of pixels; for example, as shown in FIG. 1, a row of pixels are scanned every half of a period, and each row of pixels possess two preset polarity arrangements; when the POL is at the high level, one of the two polarity arrangements is selected, and when the POL is at the low level, the other of the two polarity arrangements is selected; for example, for an individual pixel, the polarities thereof are +-+-+- in a plurality of frames; if the POL inversion is performed at the fourth frame, after the POL inversion, the polarities of this pixel are +-++-+ sequentially in the same several frames; that is, the original polarity of the pixel is inverted once; with alternative POL inversion, the direct component can be correspondingly inverted, so that the direct components are cancelled with each other in a time period and elimination of the line ship sticking is achieved. However, the pixels are charged twice with a same polarity in a frame in which the POL is inverted, overshooting is formed, so that in a static picture, human's eyes can perceive that the brightness of this frame is increased, that is, a flicker occurs.

SUMMARY

Embodiments of the present disclosure provide a polarity inversion driving method, a driving apparatus and a liquid crystal display for eliminating flickers caused by the POL inversion.

Embodiments of the present disclosure employ the follow technical solutions.

On one hand, there is provided a polarity inversion driving method for inversion of polarity of pixels on a liquid crystal panel, comprising: generating a polarity inversion reference signal for reflecting selection of polarity of each row of pixels on the liquid crystal panel; generating a control signal comprising control levels generated in m frames, where m is an integer higher than or equal to two, wherein width of the control level in each of the m frames is gradually increased in chronological order to be equal to a time length of one frame; as an alternative, the width of the control level in each of the m frames is gradually decreased in chronological order from the time length of one frame to zero; and generating a polarity inversion signal from the polarity inversion reference signal and the control signal.

According to an embodiment, the control signal comprises the control level as a high level and a non-control level as a low level, and the procedure of generating the polarity inversion signal from the polarity inversion reference signal and the control signal is as follows: performing an XOR operation between the polarity inversion reference signal and the control signal to obtain the polarity inversion signal.

According to an embodiment, after the procedure in which the width of the control level in each of the m frames is gradually increased in chronological order to be equal to the time length of one frame, the method further comprises: gradually decreasing the width of the control level in each of the n frames in chronological order from the time length of one frame to zero, where n is an integer higher than or equal to two.

According to an embodiment, after the procedure in which the width of the control level in each of the m frames is gradually decreased in chronological order from the time length of one frame to zero, the method further comprises: gradually increasing the width of the control level in each of the n frames in chronological order from zero to the time length of one frame, where n is an integer higher than or equal to two.

On the other hand, there is further provided a polarity inversion driving apparatus for inversion of polarity of pixels on a liquid crystal panel, comprising: a reference signal generation unit configured to generate a polarity inversion reference signal for reflecting selection of polarity of each row of pixels on the liquid crystal panel; a control signal generation unit configured to generate a control signal comprising control levels generated in m frames, where m is an integer higher than or equal to two, wherein width of the control level in each of the m frames is gradually increased in chronological order to be equal to the time length of one frame; as an alternative, the width of the control level in each of the m frames is gradually decreased in chronological order from the time length of one frame to zero; and an inversion signal generation unit configured to generate a polarity inversion signal from the polarity inversion reference signal and the control signal.

According to an embodiment, the control signal comprises the control level as a high level and a non-control level as a low level; and the inversion signal generation unit particularly is configured to perform an XOR operation between the polarity inversion reference signal and the control signal to obtain the polarity inversion signal.

According to an embodiment, the control signal generation unit enables, after the procedure in which the width of the control level in each of the m frames is gradually increased in chronological order to be equal to the time length of one frame, the width of the control level in each of the n frames to be gradually decreased in chronological order from the time length of one frame to zero, where n is an integer higher than or equal to two.

According to an embodiment, the control signal generation unit enables, after the procedure in which the width of the control level in each of the m frames is gradually decreased in chronological order from a time length of one frame to zero, the width of the control level in each of the n frames to be gradually increased in chronological order from zero to a time length of one frame, where n is an integer higher than or equal to two.

On the other hand, there is further provided a liquid crystal display device comprising the above polarity inversion driving apparatuses.

The polarity inversion driving method, the driving apparatus and the liquid crystal display device provided by the embodiments of the present disclosure are capable of gradually completing the POL inversion in several frames, and as compared with the known technical solution in which the POL inversion is completed in one frame, change in pictures at the time of the POL inversion is smoother and human's eye can hardly sense the flickers.

BRIEF DESCRIPTION OF THE DRAWINGS

In order to illustrate embodiments of the present disclosure or the known technical solutions more clearly, hereinafter, a simple description will be given to the drawings necessary to describe the embodiments or the known technical solutions; obviously, the drawings of the following description are only part of the embodiments of the present disclosure, and to those skilled in the art, other drawings can be obtained in accordance with these drawings without inventive work.

DETAILED DESCRIPTION

Hereinafter, the technical solution of the embodiments of the present disclosure will be clearly and fully described with reference to the drawings of the embodiments of the present disclosure. Obviously, the described embodiments are only part of the embodiments of the present disclosure, and are not all of the embodiments. Based on the embodiments of the present disclosure, all the other embodiments obtained by those skilled in the art without inventive work fall into the protection scope of the present invention.

Figure 1:
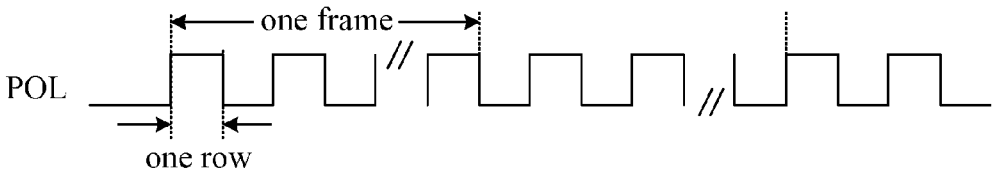
FIG. 1 is a timing chart of a POL of a known technical solution.
Figure 2:
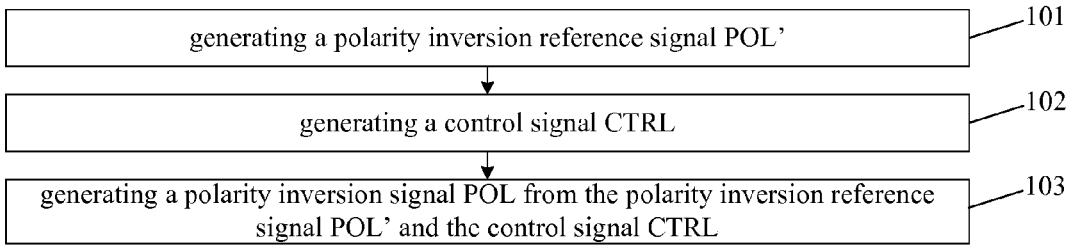
FIG. 2 is a flowchart of a polarity inversion driving method of an embodiment of the present disclosure.
Figure 3:
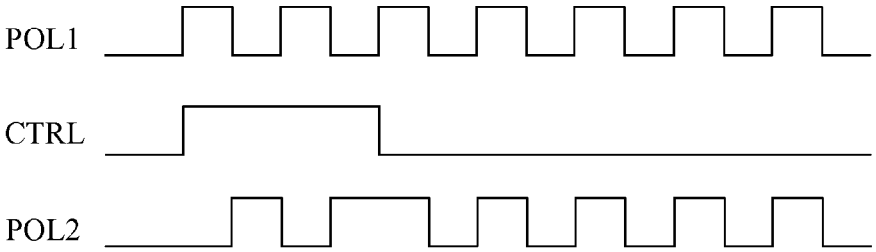
FIG. 3 is a timing diagram of a polarity inversion reference signal, a control signal, and a polarity inversion signal in an embodiment of the present disclosure.

As shown in FIG. 2, an embodiment of the present disclosure provides a polarity inversion driving method for inversion of polarity of pixels on a liquid crystal panel, comprising:

At step 101, as shown in FIG. 3, a polarity inversion reference signal POL' is generated for reflecting selection of polarity of each row of pixels on the liquid crystal panel; the POL' is equivalent to a POL which is not subjected to an inversion. For example, the POL' can be a periodic wave signal; one period of the POL' is a time when every two of the rows on the liquid crystal panel are scanned, and the POL' are inverted in every two adjacent frames; that is, the polarity is inverted once when a row of the pixels are scanned on the liquid crystal panel; it should be explained that, the polarity inversion reference signal POL' can be arranged in accordance with the pixel polarity practically required on the liquid crystal panel, and is not necessary to be a wave signal whose one period is a time period during which every two rows are scanned; for example, it can also be a wave signal whose one period is a time period in which every four rows are scanned, or signal of other forms.

At step 102, a control signal CTRL is generated which comprising control levels generated in m frames, where m is an integer higher than or equal to two.

Figure 4:
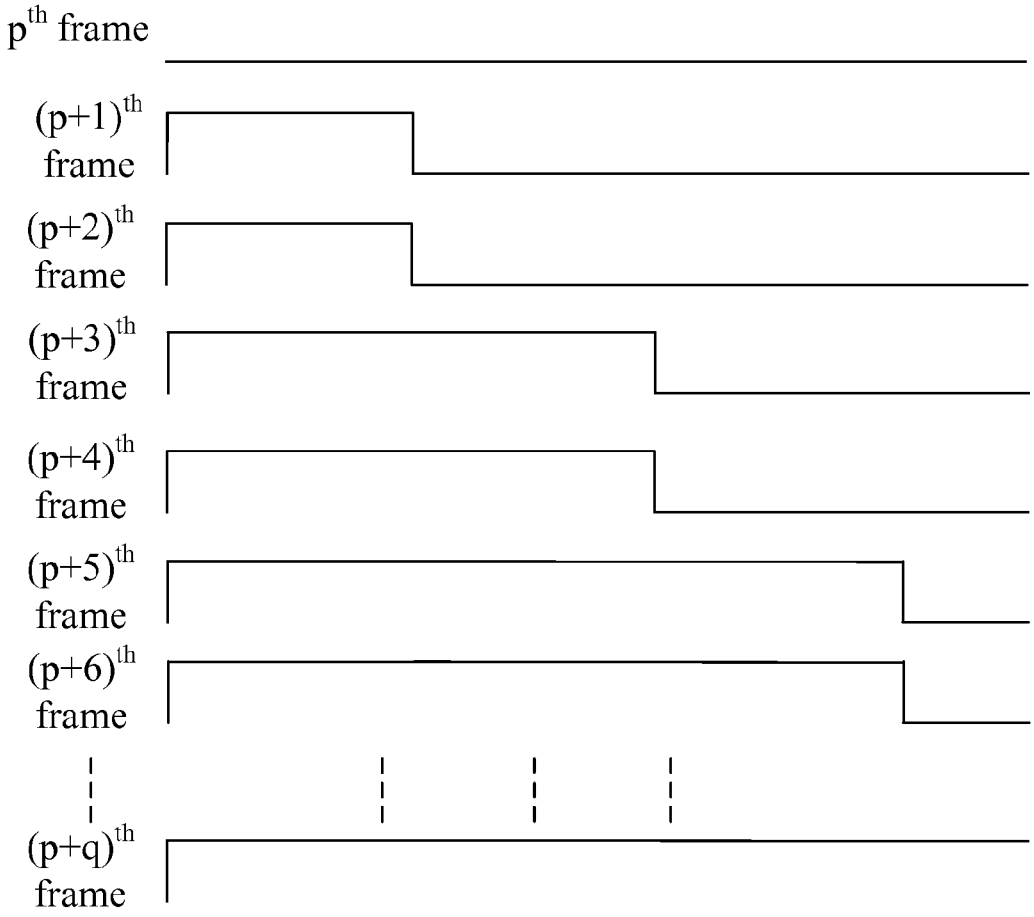
FIG. 4 is a diagram of change in a control signal in a first mode of step 102 in the embodiment of the present disclosure.

Particularly, this step can be performed in a first mode; as shown in FIG. 4, the high level is the control level, and the low level is a non-control level; width of the control level in each of the m frames is gradually increased in chronological order to be equal to the time length of one frame.

Figure 5:
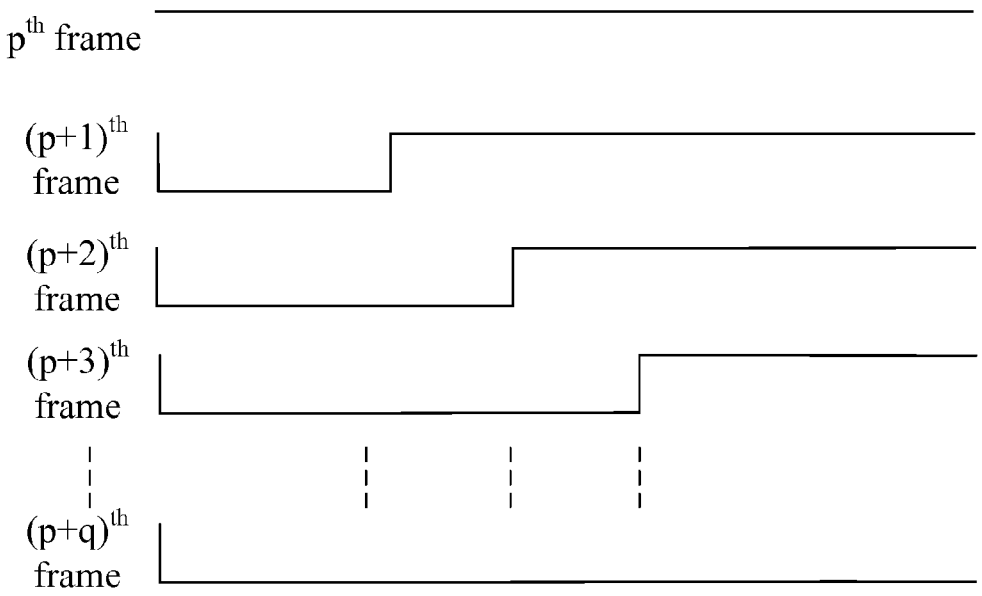
FIG. 5 is a diagram of change in a control signal in a second mode of step 102 in the embodiment of the present disclosure.

Alternatively, the step can be performed in a second mode; as shown in FIG. 5, the high level is the control level, and the low level is the non-control level; the width of the control level in each of the m frames is gradually decreased in chronological order from the time length of one frame to zero.

At step 103, as shown in FIG. 3, a polarity inversion signal POL is generated from the polarity inversion reference signal POL' and the control signal CTRL. Particularly, the polarity inversion signal POL positioned at the control level is an inversion signal of the polarity inversion reference signal POL', and the polarity inversion signal POL positioned at the non-control level is the polarity inversion reference signal POL'; the whole polarity inversion signal POL controls the polarity of the pixels, and the high and low levels of the polarity inversion signal POL respectively control different selections of pixel polarities. During a time period in which the time length of one frame is the non-control level or the control level, the polarity inversion signal POL of the present embodiment is same as an existing signal for controlling pixel polarity; the difference between the polarity inversion signal POL of the present embodiment and the existing signal for controlling pixel polarity is in that the time of the POL inversion is extended.

Particularly, taking the first mode of step 102 as an example, as shown in FIG. 4, at the p-th frame, there is no control level, and the polarity inversion reference signal POL' is the same as the polarity inversion signal POL; the control level is generated for the first time in the (p+1)-th frame; in order to facilitate generation of the control level, the width of the control level is increased once every r frames, where r is an integer higher than or equal to one; a time duration for scanning s rows (where s is an integer higher than or equal to one) is increased every time until the (p+q)-th frame when the width of the control level is equal to a time length of one frame. Particularly, the control level is generated during the time for scanning a first four rows of the (p+1)-th frame; that is, the POL is opposite to the POL' at the first four rows; the control level of the (p+2)-th frame is same as that of the (p+1)-th frame; the control level is generated during the time for scanning a first eight rows of the (p+3)-th frame; that is, the POL is opposite to the POL' at the first eight rows; the control level of the (p+4)-th frame is same as that of the (p+3)-th frame; the control level is generated during the time for scanning a first twelve rows of the (p+5)-th frame; that is, the POL is opposite to the POL' at the first twelve rows; the control level of the (p+6)-th is same as that of the (p+5)-th. In this way, at the (p+q)-th frame, the control level is generated during the time for scanning all the rows, that is, the POL is opposite to the POL' at a time duration of each of the frames, where p is a positive integer and q is an integer higher than 1. It can be seen that, at the time of the p-th frame, the POL' is same as the POL; in the frames from the (p+1)-th frame to the (p+q−1)-th frame, the POL are partly opposite to the POL', and the opposite parts are gradually increased; at time of the (p+q)-th frame, the polarity inversion reference signal POL' is totally opposite to the polarity inversion signal POL, that is, the polarity inversion signal POL gradually completes the whole POL inversion in several frames.

It can be understood that, the position and changing amplitude of the control level in different frames can be different, as long as the width of the control level in each of the frames is gradually increased in chronological order to be equal to the time length of one frame.

In addition to the first mode of step 102 in which the control level is enabled to be gradually increased in chronological order to perform the POL inversion, a second mode of step 102 can be applied to enable the control level to be gradually decreased in chronological order to perform the POL inversion; for example, as shown in FIG. 5, at the time of the p-th frame, the width of the control level is equal to a time duration of one frame, and the polarity inversion reference signal POL' is totally opposite to the polarity inversion signal POL; at the time of the (p+1)-th frame, the width of the control level is less than a time duration of one frame, and the POL is partly same as the POL'; at the time of the (p+2)-th frame, the width of the control level is further decreased as compared with the width of the control level of the previous frame, and the identical parts between the POL and the POL' are increased; the same applies until the (p+q)-th frame in which there is no control level, and the polarity inversion reference signal POL' is totally same as the polarity inversion signal POL, that is, the whole POL inversion are completed in several frames.

It should be explained that, in the procedure of achieving alternative POL inversion to eliminate the line ship sticking, the first mode and the second mode of the step 102 can be performed alternatively; before the POL inversion is not performed, if the control level is not generated yet, the first POL inversion is completed in the first mode, and then the second POL inversion is achieved in the second mode, and in the same way, the alternative POL inversion is achieved; if before the POL inversion is performed, the generated control level occupies a time duration of one frame, the first POL inversion is completed in the second mode, and then the second POL inversion is completed in the first mode; and in the same way, the alternative POL inversion is achieved. The width of the control level and the time interval of width change of the control level at the time of the POL inversion are not limited; for example, when the control level is generated for the first time, the POL inversion can be performed when the last five rows of the p-th frame are scanned, and then the POL inversion can be performed when the last twelve rows of the (p+1)-th frame are scanned, the POL inversion is performed when the first fifteen rows of the (p+2)-th frame are scanned, and the like. The specific width of the control level and the time interval of change in width of the control level can be adjusted as necessary; the faster the whole POL inversion is completed, the better the effect of eliminating the line ship sticking is; and the slower the whole POL inversion is completed, the smaller the influence of the flicker is. In addition, since steps 101, 102 and 103 are procedures for generating three signals, and it is not necessary for them to have a chronological order therebetween; it is only intended to describe different procedures, and those steps can be performed simultaneously in terms of chronological order. However, the procedure of generating the polarity inversion signal POL at step 103 is required to be performed in accordance with the generated polarity inversion reference signal POL' and control signal CTRL.

The polarity inversion driving method of the embodiments of the present disclosure is capable of gradually completing the POL inversion in several frames, and as compared with the known technical solution in which the POL inversion is completed in one frame, change in pictures at the time of the POL inversion is smoother and human's eye can hardly perceive the flickers.

Particularly, the control signal CTRL is formed by the above control level and non-control level, where the control level is a high level and the non-control level is a low level; at step 103, the procedure of generating the polarity inversion signal POL from the polarity inversion reference signal POL' and the control signal CTRL is in that an XOR operation is performed between the polarity inversion reference signal POL' and the control signal CTRL to obtain the polarity inversion signal POL.

Figure 6:
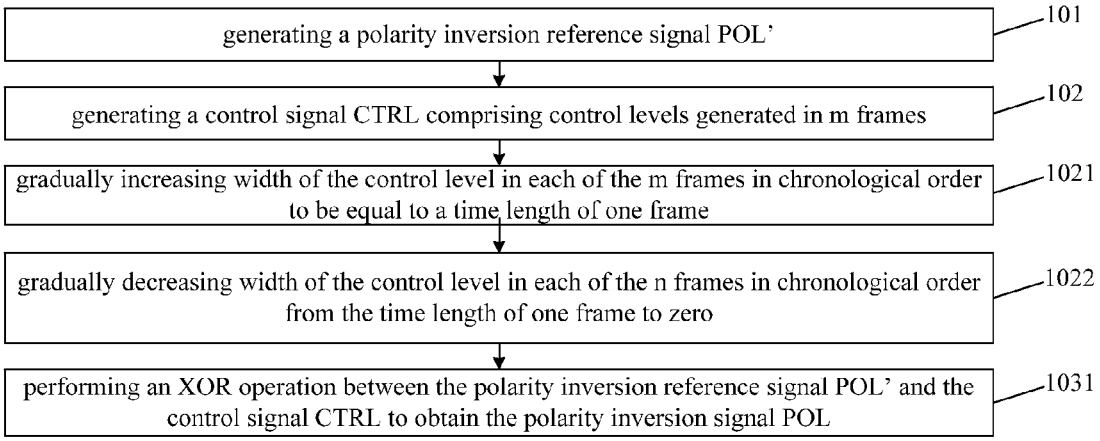
FIG. 6 is a flowchart of another polarity inversion driving method of the embodiment of the present disclosure.

Further, as shown in FIG. 6, an embodiment of the present disclosure provides a polarity inversion driving method for inversion of polarity of pixel on the liquid crystal panel, comprising: step 101 of generating, as shown in FIG. 3, a polarity inversion reference signal POL' for reflecting selection of polarity of each row of pixels on the liquid crystal panel; step 102 of generating a control signal CTRL comprising control levels generated in m frames, where m is an integer higher than or equal to two; step 1021, as shown in FIG. 4, width of the control level in each of the m frames being gradually increased in chronological order to be equal to the time length of one frame.

Particularly, this step is performed in the first mode of step 102 of the above embodiment, and will not be repeated any more.

Further, at step 1021, after the procedure in which the width of the control level in each of the m frames is gradually increased in chronological order to be equal to the time length of one frame, the method further comprises step 1022, as shown in FIG. 5, the width of the control level in each of the n frames being gradually decreased in chronological order from the time length of one frame to zero where n is an integer higher than or equal to two.

Particularly, this step is performed in the second mode of step 102 of the above embodiment, and will not be repeated any more.

At step 1031, an XOR operation is performed between the polarity inversion reference signal POL' and the control signal CTRL to obtain the polarity inversion signal POL.

Particularly, prior to step 1021, there is no control level, and after step 1021 is performed, the control signal occupies a time duration of one frame; that is, the polarity inversion signal POL is totally inverted; after the procedure of step 1022, there is no control level; that is, the inverted polarity inversion signal POL is recovered to the one before the inversion. Steps 1021 and 1022 are alternatively performed in step 102; that is, by alternatively circulating the procedures in which the width of the control level in different frames is gradually increased and decreased, the periodic inversion of the polarity inversion signal POL is achieved.

The polarity inversion driving method of the embodiments of the present disclosure is capable of gradually completing the POL inversion in several frames, and as compared with the known technical solution in which the POL inversion is completed in one frame, change in pictures at the time of the POL inversion is smoother and human's eye can hardly sense the flickers.

Figure 7:
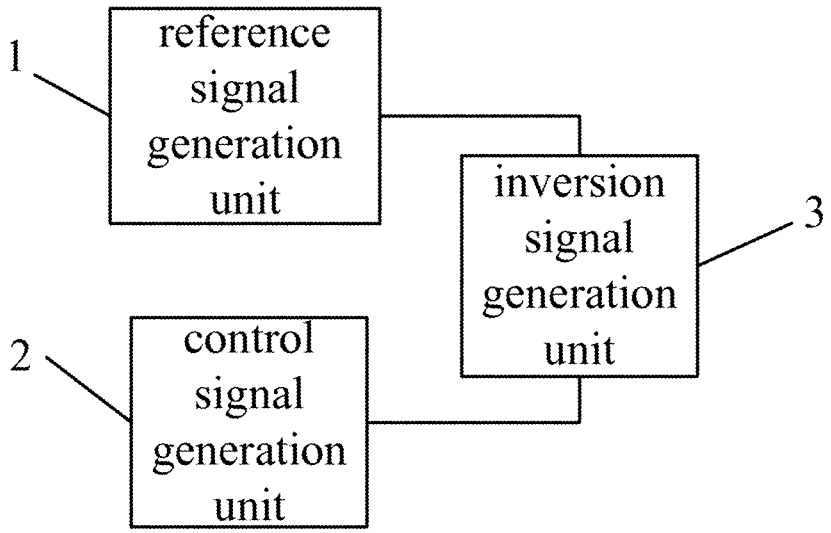
FIG. 7 is a block diagram of a polarity inversion driving apparatus of the embodiment of the present disclosure.

As shown in FIG. 7, an embodiment of the present disclosure further provides a polarity inversion driving apparatus for inversion of polarity of pixels on a liquid crystal panel, comprising: a reference signal generation unit 1 for generating a polarity inversion reference signal for reflecting selection of polarity of each row of pixels on the liquid crystal panel; a control signal generation unit 2 for generating a control signal comprising control levels generated in m frames, where m is an integer higher than or equal to two, wherein width of the control level in each of the m frames is gradually increased in chronological order to be equal to a time length of one frame; as an alternative, the width of the control level in each of the m frames is gradually decreased in chronological order from the time length of one frame to zero; and an inversion signal generation unit 3 for generating a polarity inversion signal from the polarity inversion reference signal and the control signal.

The specific polarity inversion principle and method are same as those of the above embodiments, and will not be repeated any more.

The polarity inversion driving apparatus of the embodiments of the present disclosure is capable of gradually completing the POL inversion in several frames, and as compared with the known technical solution in which the POL inversion is completed in one frame, change in pictures at the time of the POL inversion is smoother and human's eye can hardly sense the flickers.

Particularly, the control signal comprises the control level as a high level and a non-control level as a low level;

the inversion signal generation unit 3 performs the XOR operation between the polarity inversion reference signal and the control signal to obtain the polarity inversion signal.

Further, the control signal generation unit 2 enables, after the procedure in which the width of the control level in each of the m frames is gradually increased in chronological order to be equal to the time length of one frame, and the width of the control level in each of the n frames to be gradually decreased in chronological order from the time length of one frame to zero, where n is an integer higher than or equal to two.

The specific polarity inversion principle and method are same as those of the above embodiments, and will not be repeated any more.

The polarity inversion driving apparatus of the embodiments of the present disclosure is capable of gradually completing the POL inversion in several frames, and as compared with the known technical solution in which the POL inversion is completed in one frame, change in pictures at the time of the POL inversion is smoother and human's eye can hardly sense the flickers.

An embodiment of the present disclosure further provides a liquid crystal display device, comprising the above polarity inversion driving apparatus. The specific structure of the polarity inversion driving apparatus and the polarity inversion method and principle are same as those of the above embodiments, and will not be repeated any more.

The liquid crystal display device of the embodiments of the present disclosure is capable of gradually completing the POL inversion in several frames, and as compared with the known technical solution in which the POL inversion is completed in one frame, change in pictures at the time of the POL inversion is smoother and human's eye can hardly sense the flickers.

With description of the above embodiments, those skilled in the art can clearly understand that the embodiments of the present disclosure can be implemented in software and necessary general purpose hardware; of course, it is possible to be implemented in hardware; however, in most cases, the former is an optional implementation. Based on this understanding, the technical solution of the embodiments of the present disclosure can be embodied in software products, and the computer software productions are stored in a readable storage medium, such as floppy disk, hard disk, optical disk and the like comprising several instructions to enable a computer device (which can be personal computer, sever, network device and the like) to execute the methods according to respective embodiments of the present disclosure.

The above descriptions are only specific embodiments of the present disclosure, and the protection scope of the present invention is not limited thereto. The modifications or alterations which can be easily conceived by those skilled in the art in view of the embodiments of the present disclosure should be covered in the protection scope of the present invention. Therefore, the protection scope of the present invention should be defined by the protection scope of the claims.

What is claimed is:

1. A polarity inversion driving method for inversion of polarity of pixels on a liquid crystal panel, comprising:

generating a polarity inversion reference signal for reflecting selection of polarity of each row of pixels on the liquid crystal panel;

generating a control signal comprising control levels generated in m frames, where m is an integer higher than or equal to two, wherein width of the control level in each of the m frames is gradually increased in chronological order from zero to be a time length of one frame, wherein the width of the control level is increased once every r frames and a time duration for scanning s rows is increased every time until the width of the control level is equal to the time length of one frame, where r is an integer higher than or equal to one and s is an integer higher than or equal to one; or the width of the control level in each of the m frames is gradually decreased in chronological order from the time length of one frame to zero; and generating a polarity inversion signal from the polarity inversion reference signal and the control signal so as to complete a polarity inversion gradually in a time period of a plurality of frames.

2. The polarity inversion driving method according to claim 1, wherein, the control signal comprises the control level as a high level and a non-control level as a low level; wherein generating the polarity inversion signal from the polarity inversion reference signal and the control signal is as follows: performing an XOR operation between the polarity inversion reference signal and the control signal to obtain the polarity inversion signal.

3. The polarity inversion driving method according to claim 2, further comprising, after the width of the control level in each of the m frames is gradually increased in chronological order to be equal to a time length of one frame, gradually decreasing the width of the control level in each of the n frames in chronological order from the time length of one frame to zero, where n is an integer higher than or equal to two.

4. The polarity inversion driving method according to claim 2, further comprising, after the width of the control level in each of the m frames is gradually decreased in chronological order from the time length of one frame to zero, gradually increasing the width of the control level in each of the n frames in chronological order from zero to a time length of one frame, where n is an integer higher than or equal to two.

5. The polarity inversion driving method according to claim 1, further comprising, after the width of the control level in each of the m frames is gradually increased in chronological order to be equal to a time length of one frame, gradually decreasing the width of the control level in each of the n frames in chronological order from the time length of one frame to zero, where n is an integer higher than or equal to two.

6. The polarity inversion driving method according to claim 1, further comprising, after the width of the control level in each of the m frames is gradually decreased in chronological order from the time length of one frame to zero, gradually increasing the width of the control level in each of the n frames in chronological order from zero to a time length of one frame, where n is an integer higher than or equal to two.

7. A polarity inversion driving apparatus for inversion of polarity of pixels on a liquid crystal panel, comprising:

a reference signal generation unit configure to generate a polarity inversion reference signal for reflecting selection of polarity of each row of pixels on the liquid crystal panel;

a control signal generation unit configure to generate a control signal comprising control levels generated in m frames, where m is an integer higher than or equal to two, wherein width of the control level in each of the m frames is gradually increased in chronological order from zero to be equal to a time length of one frame, wherein the width of the control level is increased once every r frames and a time duration for scanning s rows is increased every time until the width of the control level is equal to the time length of one frame, where r is an integer higher than or equal to one and s is an integer higher than or equal to one; as an alternative, the width of the control level in each of the m frames is gradually decreased in chronological order from a time length of one frame to zero; and an inversion signal generation unit configure to generate a polarity inversion signal from the polarity inversion reference signal and the control signal so as to complete a polarity inversion gradually in a time period of a plurality of frames.

8. The polarity inversion driving apparatus according to claim 7, wherein, the control signal comprises the control level and a non-control level, wherein the control level is a high level, and the non-control level is a low level; and the inversion signal generation unit configure to perform an XOR operation between the polarity inversion reference signal and the control signal to obtain the polarity inversion signal.

9. The polarity inversion driving apparatus according to claim 8, wherein, the control signal generation unit configure to enable, after the width of the control level in each of the m frames is gradually increased in chronological order to be equal to a time length of one frame, the width of the control level in each of the n frames to be gradually decreased in chronological order from the time length of one frame to zero, where n is an integer higher than or equal to two.

10. The polarity inversion driving apparatus according to claim 8, wherein, the control signal generation unit configure to enable, after the width of the control level in each of the m frames is gradually decreased in chronological order from the time length of one frame to zero, the width of the control level in each of the n frames to be gradually increased in chronological order from zero to the time length of one frame, where n is an integer higher than or equal to two.

11. The polarity inversion driving apparatus according to claim 7, wherein, the control signal generation unit configure to enable, after the width of the control level in each of the m frames is gradually increased in chronological order to be equal to a time length of one frame, the width of the control level in each of the n frames to be gradually decreased in chronological order from the time length of one frame to zero, where n is an integer higher than or equal to two.

12. The polarity inversion driving apparatus according to claim 7, wherein, the control signal generation unit configure to enable, after the width of the control level in each of the m frames is gradually decreased in chronological order from the time length of one frame to zero, the width of the control level in each of the n frames to be gradually increased in chronological order from zero to the time length of one frame, where n is an integer higher than or equal to two.

13. A liquid crystal display device, comprising any one of the polarity inversion driving apparatuses according to claim 7.

14. The liquid crystal display device according to claim 13, wherein, the control signal comprises the control level and a non-control level, wherein the control level is a high level, and the non-control level is a low level; and the inversion signal generation unit configure to perform an XOR operation between the polarity inversion reference signal and the control signal to obtain the polarity inversion signal.

15. The liquid crystal display device according to claim 14, wherein, the control signal generation unit configure to enable, after the width of the control level in each of the m frames is gradually increased in chronological order to be equal to a time length of one frame, the width of the control level in each of the n frames to be gradually decreased in chronological order from the time length of one frame to zero, where n is an integer higher than or equal to two.

16. The liquid crystal display device according to claim 14, wherein, the control signal generation unit configure to enable, after the width of the control level in each of the m frames is gradually decreased in chronological order from the time length of one frame to zero, the width of the control level in each of the n frames to be gradually increased in chronological order from zero to the time length of one frame, where n is an integer higher than or equal to two.

17. The liquid crystal display device according to claim 13, wherein, the control signal generation unit configure to enable, after the width of the control level in each of the m frames is gradually increased in chronological order to be equal to a time length of one frame, the width of the control level in each of the n frames to be gradually decreased in chronological order from the time length of one frame to zero, where n is an integer higher than or equal to two.

18. The liquid crystal display device according to claim 13, wherein, the control signal generation unit configure to enable, after the width of the control level in each of the m frames is gradually decreased in chronological order from the time length of one frame to zero, the width of the control level in each of the n frames to be gradually increased in chronological order from zero to the time length of one frame, where n is an integer higher than or equal to two.

* * * * *